US009345287B2

(12) United States Patent
Dananberg et al.

(10) Patent No.: US 9,345,287 B2
(45) Date of Patent: May 24, 2016

(54) HEEL STABILIZER FOR FOOTWEAR

(71) Applicant: HBN SHOE, LLC, Salem, NH (US)

(72) Inventors: Howard Dananberg, Stowe, VT (US); Brian G. R. Hughes, San Antonio, TX (US)

(73) Assignee: HBN SHOE, LLC, Salem, NH (US)

( * ) Notice: Subject to any disclaimer, the term of this patent is extended or adjusted under 35 U.S.C. 154(b) by 95 days.

(21) Appl. No.: 14/189,733

(22) Filed: Feb. 25, 2014

(65) Prior Publication Data

US 2014/0259771 A1 Sep. 18, 2014

Related U.S. Application Data

(63) Continuation-in-part of application No. 13/826,376, filed on Mar. 14, 2013.

(51) Int. Cl.

| | |
|---|---|
| ***A43B 3/14*** | (2006.01) |
| ***A43B 19/00*** | (2006.01) |
| ***A43B 23/17*** | (2006.01) |
| ***A43B 23/28*** | (2006.01) |

(52) U.S. Cl.

CPC . *A43B 23/28* (2013.01); *A43B 3/14* (2013.01); *A43B 19/00* (2013.01); *A43B 23/17* (2013.01)

(58) Field of Classification Search

CPC ..... A43B 3/28; A43B 7/20; A43B 23/28; A43B 23/088; A43B 5/0439; A43B 3/30; A43B 23/17; A43B 19/00; A43B 4/14

USPC ..... 36/83, 92, 58.6, 1.5, 105, 88, 71, 58.5, 36/93

See application file for complete search history.

(56) References Cited

U.S. PATENT DOCUMENTS

| | | | | | |
|---|---|---|---|---|---|
| 395,271 | A | * | 12/1888 | Benedict | A43B 3/16 36/58.6 |
| 1,749,084 | A | | 3/1930 | McCarthy | |
| 1,900,107 | A | | 3/1933 | Handler | |
| 1,958,619 | A | * | 5/1934 | Handler | A43B 23/28 248/363 |
| 1,966,179 | A | * | 7/1934 | Lesch | 36/58.5 |
| 2,821,032 | A | | 1/1958 | Helfet | 36/71 |
| 2,912,771 | A | | 11/1959 | Harrison | 36/2.5 |

(Continued)

FOREIGN PATENT DOCUMENTS

| | | |
|---|---|---|
| CH | 212394 | 1/1940 |
| DE | 1610687 | 12/1948 |

(Continued)

OTHER PUBLICATIONS

Office Action issued in related U.S. Appl No. 13/826,376, dated Mar. 27, 2014 (18 pgs).

(Continued)

*Primary Examiner* — Robert J Hicks
*Assistant Examiner* — Timothy K Trieu
(74) *Attorney, Agent, or Firm* — Hayes Soloway P.C.

(57) ABSTRACT

A heel stabilizer for use with human footwear that reduces or eliminates upward movement of the heel within footwear is disclosed herein. The heel stabilizer preferably includes two gripping portions or parts that grip the heel on the medial and lateral surfaces of the foot, preferably above the widest part of the heel. The heel stabilizer may be integrated directly into footwear. Alternatively, the heel stabilizer may be a separate insert that can be inserted into footwear.

14 Claims, 8 Drawing Sheets

(56) References Cited

U.S. PATENT DOCUMENTS

| | | | | | |
|---|---|---|---|---|---|
| 3,613,274 | A | | 10/1971 | Willey | 36/68 |
| 3,780,454 | A | | 12/1973 | Godwin | 36/58.6 |
| 4,503,628 | A | * | 3/1985 | Mancinelli | A43B 23/28 36/58.6 |
| 5,669,162 | A | | 9/1997 | Dyer | 36/44 |
| 5,799,416 | A | * | 9/1998 | Prober | 36/58 |
| 5,842,292 | A | | 12/1998 | Siesel | 36/58.5 |
| 6,041,524 | A | | 3/2000 | Brooks | 36/93 |
| 6,101,655 | A | | 8/2000 | Buddle | 12/146 C |
| 6,442,874 | B1 | | 9/2002 | Long | 36/97 |
| 6,584,707 | B1 | | 7/2003 | Racine et al. | 36/97 |
| 6,732,456 | B2 | | 5/2004 | Hussain | 36/144 |
| 7,168,188 | B2 | | 1/2007 | Auger et al. | 36/69 |
| 7,243,446 | B2 | | 7/2007 | Vindriis | 36/141 |
| 7,849,611 | B2 | | 12/2010 | Dean | 36/89 |
| 2002/0007568 | A1 | | 1/2002 | Kellerman et al. | 36/28 |
| 2004/0049951 | A1 | | 3/2004 | Chen | 36/93 |
| 2006/0265904 | A1 | | 11/2006 | Fujita et al. | 36/25 |
| 2007/0028713 | A1 | | 2/2007 | Morgan | 74/489 |
| 2009/0249649 | A1 | | 10/2009 | Schenone | 36/97 |

FOREIGN PATENT DOCUMENTS

| | | | |
|---|---|---|---|
| FR | 731103 | 2/1932 | |
| GB | 270033 | 5/1927 | |
| GB | 364732 | 1/1932 | |
| GB | 1131451 | 11/1964 | |
| GB | 2429395 | 2/2007 | A43B 23/07 |
| JP | S5030941 | 4/1975 | |

OTHER PUBLICATIONS

Examination Report issued in corresponding Great Britain Application Serial No. GB1313166.9 dated Apr. 17, 2015 (2 pgs).
Final Office Action issued in related U.S. Appl. No. 13/826,376 dated Apr. 28, 2015 (14 pgs).
Office Action issued in related U.S. Appl. No. 13/826,376, dated May 8, 2014 (10 pgs).
European Search Report issued in related application No. EP 14 15 8380, dated May 27, 2014 (7 pgs).
Office Action issued in U.S. Appl. No. 13/826,376, dated Jul. 7, 2015 (19 pgs).
International Search Report and Written Opinion issued in related application No. PCT/US14/20805, dated Jul. 8, 2014 (10 pgs).
Official Action issued in related U.S. Appl. No. 13/826,376 dated Nov. 21, 2014 (25 pgs).
Great Britain Patent Office Appln. No. 1313166.9 Communication and Search Report , dated Feb. 10, 2014, 4 pgs.
Office Action issued in U.S. Appl. No. 13/826,376, dated Dec. 22, 2015 (24 pgs).
Office Action issued in U.S. Appl. No. 13/826,376, dated Sep. 11, 2015 (29 pgs).
International Preliminary Report on Patentability issued in application No. PCT/US2014/020805, dated Sep. 24, 2015 (9 pgs).
Notice of First Action and English translation issued in corresponding Chinese Appln No. 201410092384.4, dated Jun. 19, 2015 (13 pgs).
Office Action issued in U.S. Appl. No. 13/826,376, dated Mar. 8, 2016 (16 pgs).

* cited by examiner

HEEL STABILIZER FOR FOOTWEAR

CROSS REFERENCE TO RELATED APPLICATION

This application is a continuation-in-part of our co-pending application Ser. No. 13/826,376, filed Mar. 14, 2013.

FIELD OF THE INVENTION

This invention relates to footwear, and more specifically to a heel motion stabilizer for footwear having features that improve comfort and performance for the wearer during standing, walking, running, and other activities in which footwear is used.

BACKGROUND OF THE INVENTION

Footwear of all types and sizes are known to slip in the heels. Typically, there are two types of motion, up and down, and side-to-side. The resulting rubbing of the wearer's heels against the footwear is therefore a common problem, causing discomfort for the wearer and sometimes even painful blisters, bruises, or other injuries. The problem is particularly acute in the case of men's and women's dress shoes. Additionally, and in the case of footwear used for athletic activities, such as ski boots, heel slippage may not only result in pain and discomfort, but also in a loss of control for the wearer, thereby reducing the performance level of the footwear.

Various products exist to prevent this problem, many of which are either ineffective or only partially effective. These products, which typically are used in women's dress shoes, often simply consist of a thickened pad located across the entire back of the heel. Others products use a pad located at the tongue of the shoe that fits across the top of the wearer's foot when the shoe is worn. These products essentially prevent slippage by effectively making the footwear smaller in length from the heel to the toes. As a result, these products may cause additional discomfort and/or pain for the wearer. Accordingly, new solutions to this problem are required that can effectively reduce or eliminate the heel rubbing against footwear without causing any additional pain or discomfort, thereby increasing overall comfort and performance for the wearer.

SUMMARY OF THE INVENTION

The present invention overcomes the disadvantages of the prior art by providing a heel stabilizer for footwear that "grips" the wearer's heel at the medial and lateral surfaces of the heel, thereby providing reduced up and down and side-to-side movement without pain or discomfort. The prior art solutions to heels rubbing against footwear primarily focused on the top part of the heel near the top of the center back counter of the footwear, where the rubbing often occurs against the Achilles tendon of the wearer. However, because those products do not properly focus on reducing heel movement, they simply don't work, and may result in more rubbing and therefore more discomfort.

We have discovered that the true cause of the problem typically lies in the movement of the bottom portion of the heel within the footwear. This movement may result from a variety of causes including, for example, the footwear's design and/or its fit, the size and/or shape of the wearer's foot, or a combination of these and similar issues. Thus, the heel stabilizer disclosed herein primarily reduces movement of the bottom portion of the heel, preferably by stabilizing a narrower portion of the heel. By "gripping" the heel at the medial and lateral surfaces, and particularly at a location above the widest part of the heel, overall heel movement is more effectively reduced or eliminated, as is the resulting rubbing of the heel against the footwear and the accompanying pain and discomfort.

Accordingly, the heel stabilizer disclosed herein comprises a first portion and a second portion, or a first part and a second part, each of which protrudes away from an inner surface of footwear adjacent the medial and lateral portions of the heel. When the footwear is worn, the first portion or part will be adjacent to and in direct or indirect contact with the medial surface of the wearer's heel. The second portion or part will be adjacent to and in direct or indirect contact with the lateral surface of the wearer's heel. Either or both portions or parts may have a top side having a generally convex shape and a bottom side having a generally concave shape. The size of each portion or part may vary depending on, for example, the size and shape of the wearer's foot and the type and design of the footwear with which the stabilizer is used. The first portion or part also should be larger than the second portion or part to account for differences in the sizes of the medial and lateral surfaces of the wearer's heel. The second portion or part ideally preferably also should have a contour of include a notch of sufficient depth, length, and width to accommodate, and prevent irritation to the wearer's sural nerve. A variety of materials of differing stiffness, hardness, flexibility, density, and other characteristics may be used, depending on, for example, the type and design of the footwear, the wearer's individual foot, and/or the intended use of the footwear.

In one embodiment, the heel stabilizer may be manufactured into the footwear itself. Accordingly, the stabilizer may be molded into an interior surface of the footwear. For instance, the stabilizer may be molded into an interior surface of the heel counter of the footwear.

In another embodiment, the heel stabilizer may be manufactured as a separate article or articles that may be inserted into footwear during footwear manufacturing. Thus, the first and second portions or parts of the stabilizer insert may protrude from a common backing which may be inserted into footwear so that when the footwear is worn, the first and second portions or parts are adjacent to and in direct or indirect contact with the medial and lateral surfaces of the wearer's heel, respectively. A variety of materials of differing flexibility, textures, and other characteristics may be used, depending on, for example, the type and design of the footwear, the wearer's individual foot, and the intended use of the footwear with which the insert will be used. Positioning the insert in the shoe is important. Accordingly, the portions or parts should include an adhesive to allow the stabilizer insert to be securely affixed in position to the inside of the footwear. The stabilizer insert may also include markings or other indicators to aid in properly aligning the insert within the footwear.

The size and material of the stabilizer may be varied as described above to provide the desired level of comfort and stabilization.

DETAILED DESCRIPTION

Figure 1:
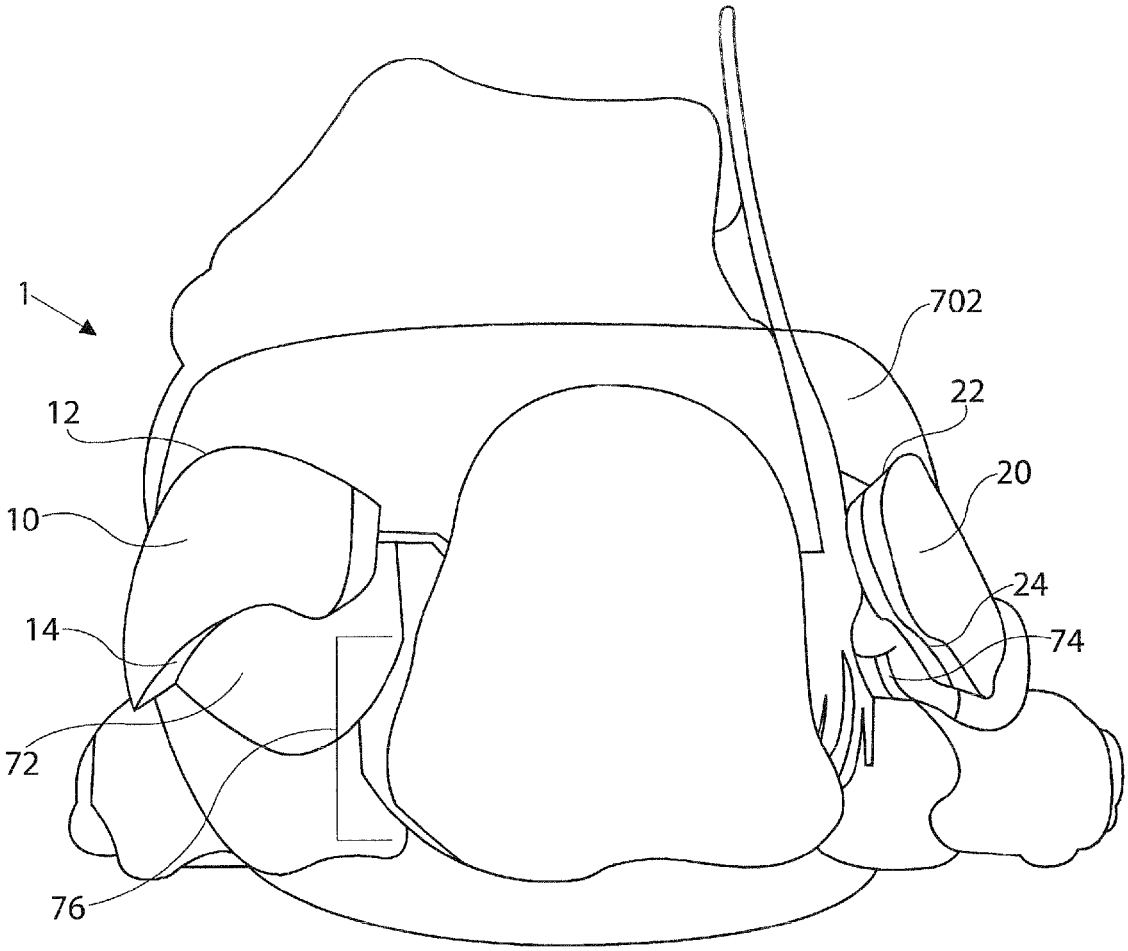
FIG. 1 illustrates an embodiment of the heel stabilizer positioned on a human right foot when in use.

FIG. 1 illustrates a rear view of heel stabilizer 1 positioned on a human right foot 70. The stabilizer 1 includes a first gripping portion or part 10 and a second gripping portion or part 20. In use, the heel stabilizer may be positioned within a shoe or other type of footwear such that, when the footwear is worn, the first gripping portion or part 10 will be positioned adjacent to the medial, or "inside," surface 72 of the wearer's heel and the second gripping portion or part 20 will be positioned adjacent to the lateral, or "outside," surface 74 of the wearer's heel, as depicted in FIG. 1. For a human left foot, the relative positions of the first and second gripping portions or parts would be a mirror image of the positions shown in FIG. 1. That is, from a similar rear view of a human left foot, the medial surface and first gripping portion or part would appear on the "inside" or right side of the foot, and the lateral surface and second gripping portion or part would appear on the "outside" or left side of the foot.

As shown in FIG. 1, the human heel has a "pear-shaped" appearance when viewed from the rear of the heel. Accordingly, the heel is widest in thickness near the bottom of the foot, when thickness is measured from the medial surface to the lateral surface. The thickness of the heel decreases near the top of the heel. Accordingly, the heel stabilizer should be positioned above the widest portion 76 of the heel, as depicted in FIG. 1. This positioning will allow the heel stabilizer to grip the widest part of the heel from above. Also, the heel stabilizer will be positioned below the top line of the footwear, such that it is not visible from or otherwise protruding to the exterior of the footwear. Accordingly, the proper positioning of the first and second gripping portions or parts on the medial and lateral surfaces of the wearer's heel may need to be adjusted up or down depending on the footwear used and the specific size and shape of the wearer's foot.

The first and second gripping portions or parts may vary in size and shape. Variations in size and shape may be due to specific physical characteristics of the footwear and the wearer's foot. However, as a practical matter, there is actually little variation in the anatomical shape of the heel of a human's foot other than, of course size, which varies primarily with shoe size. In a preferred embodiment, the gripping portions or parts 10 and 20 will be shaped to generally match the anatomical shape of the medial and lateral surfaces of the wearer's heel. Accordingly, the first gripping portion or part 10 includes a top side 12 having a generally convex shape and a bottom side 14 having a generally concave shape. Similarly, the second gripping portion or part 20 includes a top side 22 having a generally convex shape and a bottom side 24 having a generally concave shape.

The first and second gripping portions or parts vary in size and shape relative to each other to accommodate for the shape of the heel. Accordingly, the first gripping portion or part should be larger in size than the second gripping portion or part. This is primarily due to the larger size of the medial surface of the heel relative to the lateral surface. For example, the first gripping portion or part may be approximately 30 to 70% larger, preferably about 50% larger in size than the second gripping portion or part.

The gripping portions or parts 10 and 20 protrude a sufficient distance away from the backing such that they will be positioned adjacent to and in contact with the medial and lateral surfaces of the wearer's heel when in use, as described above. If the wearer is wearing socks or other hosiery when using the heel stabilizer, the gripping portions or parts will indirectly contact the wearer's heel through the wearer's hosiery. Alternatively, if the wearer is not wearing socks or other hosiery when using the heel stabilizer, the gripping portions or parts will directly contact the wearer's heel. The two situations are deemed equivalent for the purposes of this disclosure and both fall within the scope of this disclosure. The first and second gripping portions or parts may protrude sufficiently far that they are compressed between the footwear and the wearer's heel when in use.

Figure 2:
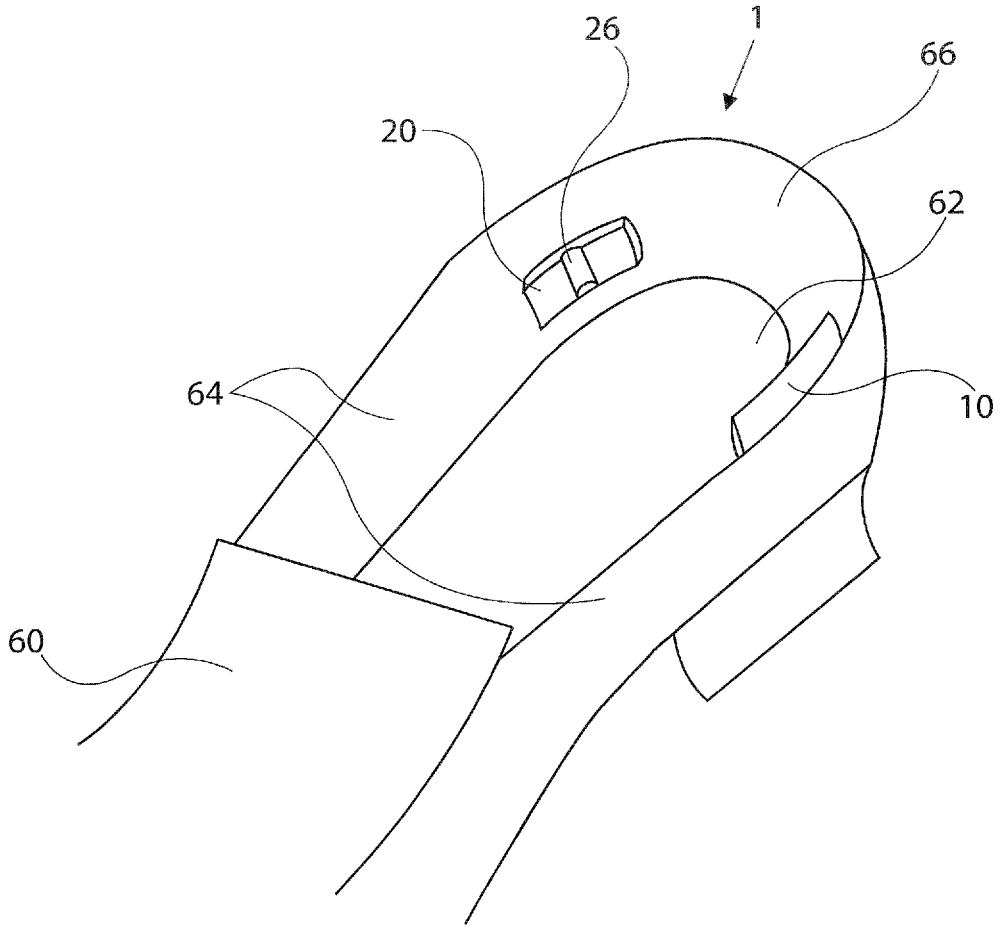
FIG. 2 is a perspective view of an embodiment of the heel stabilizer molded into a right shoe.
Figure 3:
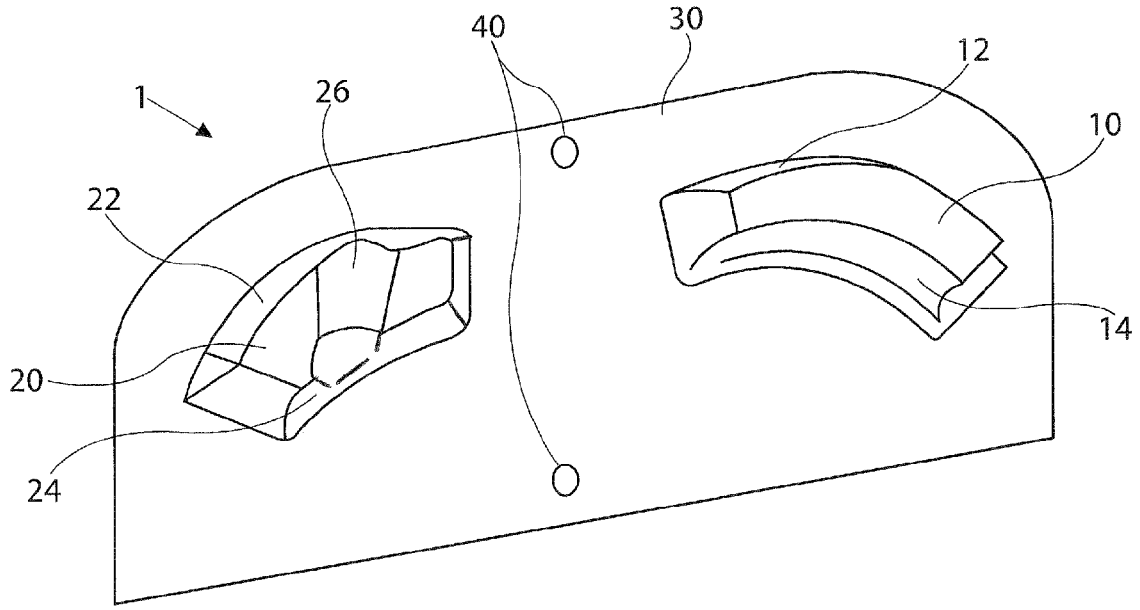
FIG. 3 is a perspective view of an embodiment of a right heel stabilizer insert.
Figure 8:
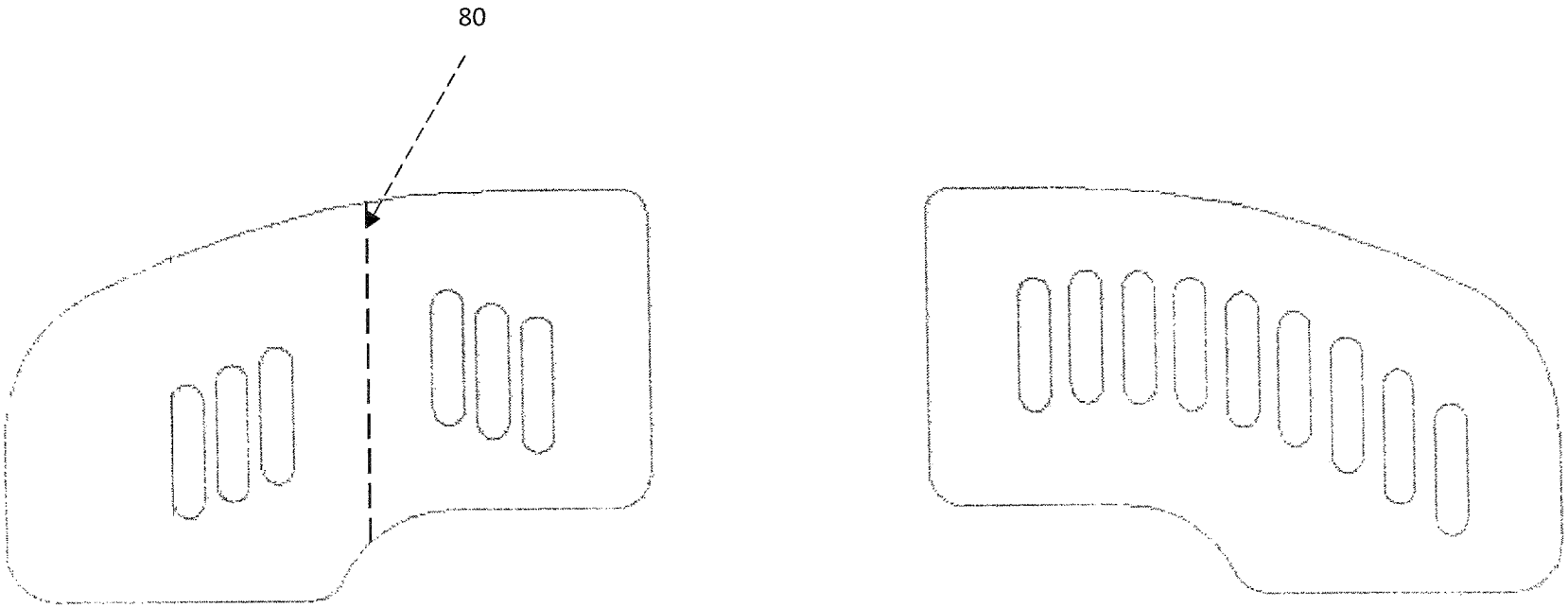
FIG. 8 is a front view of the alternative embodiment of FIG. 7.

The second gripping portion or part 20 ideally should further be contoured or comprise a notch 26 to accommodate the wearer's sural nerve. The sural nerve is generally positioned on the lateral or "outside" surface of the foot, under and behind the ankle bone. Discomfort may be caused by any pressure placed on the nerve. Thus, in a preferred embodiment, the second gripping portion or part will be contoured or include a notch of sufficient length, width, and depth to accommodate the wearer's sural nerve, and thereby alleviate any undesired pressure on the nerve. The notch should be located on the surface or surfaces of the second gripping portion or part that contacts the wearer's foot, as is depicted in FIG. 2. The notch should also be of a sufficient length, width, and depth to accommodate any part of the sural nerve that may come into contact with the second gripping portion or part. For example, a deep notch that is 3 mm wide and runs from the top surface of the second gripping portion or part to the bottom surface may sufficiently accommodate a wearer's sural nerve. Other sizes, positions, and orientations for the notch may be selected, depending on such considerations as the type of footwear used and the specific size and shape of the wearer's foot. Also, if desired, rather than having a notch or contour part 20 could be made as two parts, and separated to accommodate the wearer's sural nerve, i.e., as shown in FIG. 8 by broken lines 80.

The gripping portions or parts 10 and 20 of the heel stabilizer 1 may be made from a variety of materials. In a preferred embodiment, the gripping portions or parts will be a foam material. For example, a firm neoprene/vinyl/Buna-N blend may be used. Other materials of differing firmness, flexibility, density, stiffness, and hardness may be used without departing from the scope of the present disclosure. Preferably, the material used will provide sufficient flexibility such that it may be compressed between the footwear and the wearer's shoe when in use to allow for a comfortable fit. In addition, the material, if installed in a shoe during manufacture must also take into account the lasting process, and be able to recover to a useful configuration after the last is removed. However, the material also should be sufficiently firm to effectively reduce or eliminate movement of the wearer's heel within the footwear.

Figure 5:
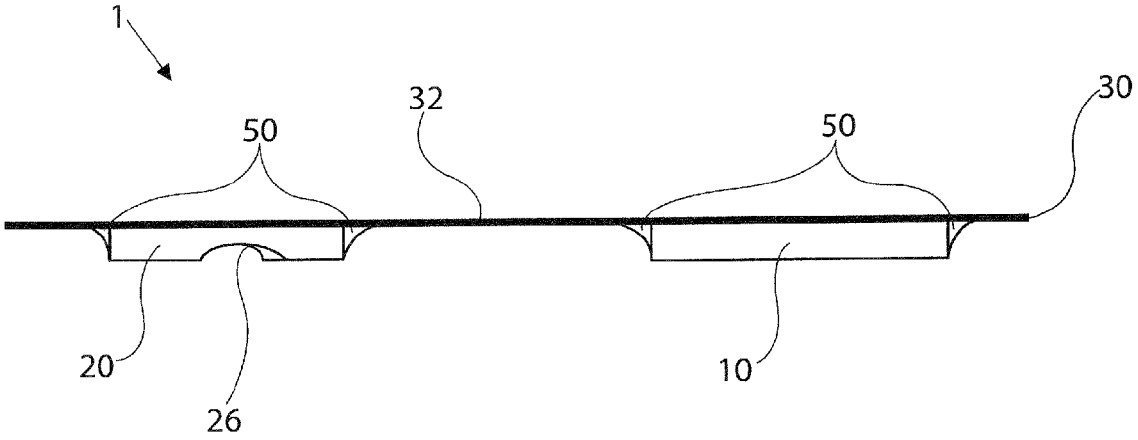
FIG. 5 is a top view of an embodiment of a right heel stabilizer insert.
Figure 6:
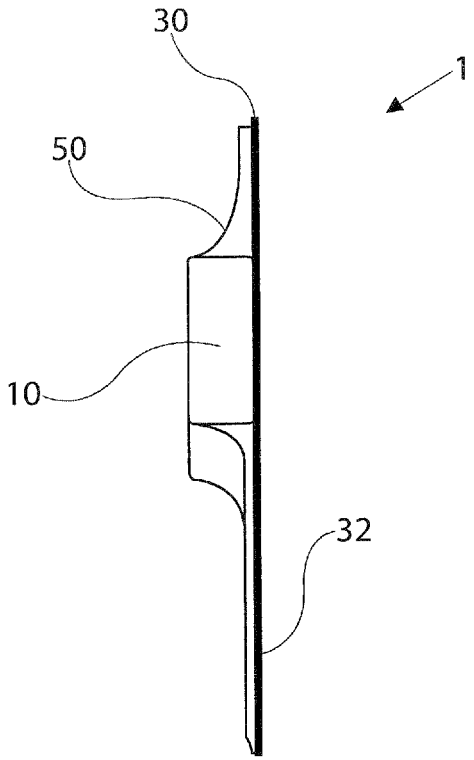
FIG. 6 is a side view of an embodiment of a right heel stabilizer insert.

In another preferred embodiment, at least one additional material may be used to cover the heel stabilizer. Various materials may be used, but the material should be selected to increase or maximize comfort and durability, among other characteristics. In one embodiment, a thin layer of material 50 may cover the heel stabilizer, as shown in FIGS. 5-6. For example, a thin layer of suede, leather, silk, or cotton may be used to cover the heel stabilizer. Synthetic materials, such as nylon or polyester also may be used, as well as blends of the foregoing materials, without departing from the scope of this disclosure.

In a preferred embodiment, heel stabilizer 1 may be integrated directly into the footwear with which the stabilizer is to be used. In one embodiment, the heel stabilizer may be molded directly into the shoe or other footwear. Alternatively, the heel stabilizer may be securely fastened to the shoe or other footwear through means commonly known in the art, such as, for example, staples, screws, or adhesives.

For example, as shown in FIG. 2, heel stabilizer 1 may be integrated into shoe 60. Right shoe 60 has an insole 62 on which the wearer's foot rests when the shoe is worn. An upper portion 64 rises above the insole 62 and surrounds a top portion of the wearer's foot. The rearmost part of the upper portion 64 is a heel counter 66, which is typically stiffer than the rest of the upper portion, thereby providing additional support for the wearer at the rear of the shoe. First gripper portion or part 10 and second gripper portion or part 20 protrude into the interior of the shoe from a surface of upper portion 64 such that when the shoe is worn, first gripper portion or part 10 will be adjacent to the medial surface of the wearer's heel and second gripper portion or part 20 will be adjacent to the lateral surface of the wearer's heel. The first and second gripping portions or parts may be positioned within the shoe such that they overlap or partially overlap heel counter 66. In a preferred embodiment, the first and second gripper portions or parts will contact the wearer's heel at positions above the widest portion of the wearer's heel, but will not rise above the top edge of the shoe 68. Second gripping portion or part 20 may also include a notch 26, as described above, to accommodate the wearer's sural nerve.

In one embodiment, heel stabilizer 1 comprises a single piece or insert that can be inserted into footwear, as is depicted in FIGS. 3-6. The first gripping portion or part 10 and the second gripping portion or part 20 protrudes outward and away from a bridging material 30. Since the position of its insert is important, the insert should be permanently affixed to the footwear after initial insertion, using, e.g. a pressure sensitive adhesive.

The bridging material 30 provides a supportive structure for the first and second gripping portions or parts 10 and 20. It should be sufficiently large enough to maintain the first and second gripping portions at a proper distance from each other and from the insole of the footwear such that each gripping portion may be in contact with the medial and lateral surfaces of the wearer's heel when the heel stabilizer is in use. However, the preferred size of the bridging material may depend on the type of footwear with which it is used. In a preferred embodiment, the backing will fit entirely within the interior of the footwear such that no part of the heel stabilizer protrudes outside of the footwear or is visible when the footwear is worn.

Alternatively, the heel stabilizer may comprise separate gripping portions, or parts, such that the two gripping portions or parts may be inserted separately into the footwear, i.e. as shown in FIG. 2.

In a preferred embodiment, the heel stabilizer may also include at least one alignment indicator 40 to assist the wearer with properly aligning the stabilizer within the footwear. The indicator may comprise indicia or graphical markings, such as lines, circles, and arrows, textual markings, physical markings, such as a hole or a protrusion, or a combination of the foregoing.

Figure 4:
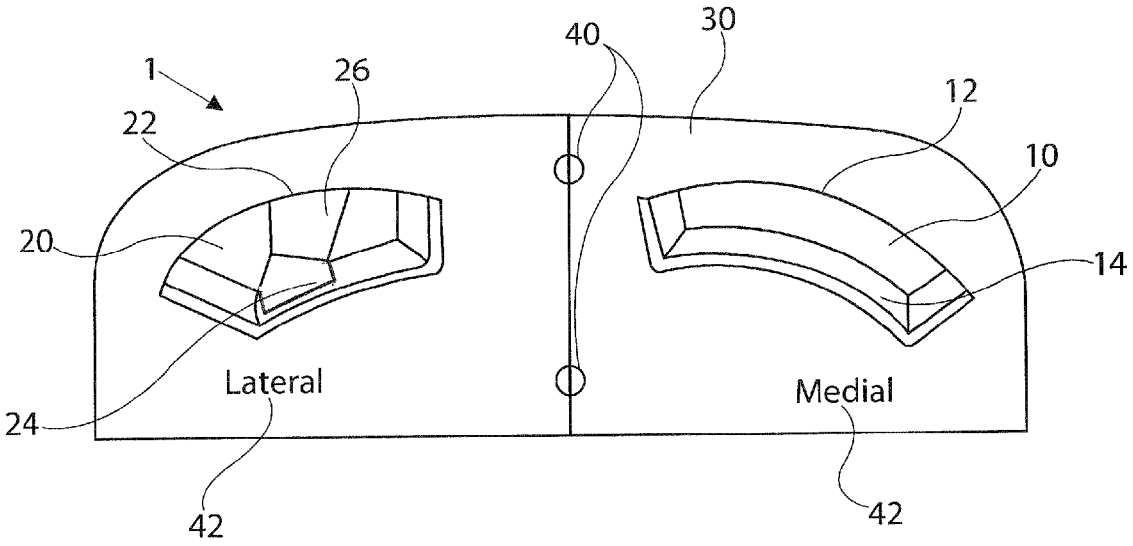
FIG. 4 is a front view of an embodiment of a right heel stabilizer insert.

As is shown in FIG. 4, the heel stabilizer may further include labels 42 to assist the wearer with placing the stabilizer appropriately within the footwear. The labels 42 may, for example, include terms such as "medial" and "lateral," "inside" and "outside," or "right" and "left" to indicate the proper placement of the stabilizer within the footwear.

Bridging material 30 further comprises a rear surface 32, as shown in FIGS. 5-6. Rear surface 32 may comprise an adhesive portion 34. The adhesive portion comprises an adhesive that will allow the wearer to securely affix the insert to the interior of the footwear. Various adhesives may be used, including, for example, tape, double-sided tape, glue, chemical adhesives, etc.

Figure 7:
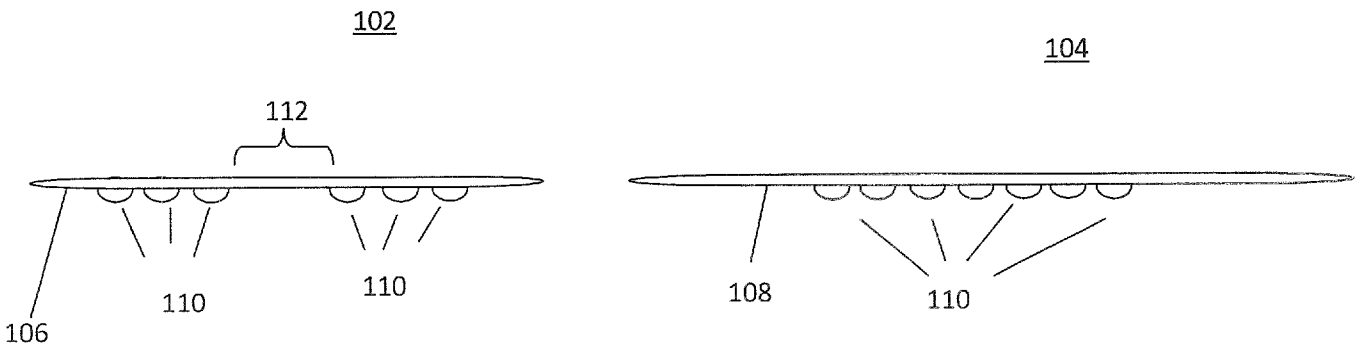
FIG. 7 is a new, similar to FIG. 5, of an alternative embodiment of a right heel stabilizer insert.

FIGS. 7 and 8 illustrate another embodiment. In the FIGS. 7 and 8 embodiment the heel stabilizer comprises a first gripper part 102 and a second gripper part 104 having a plan shape similar to the heel stabilizers shown in FIGS. 3 and 4. The first and second gripper parts 102, 104 comprise bridging materials 106, 108 to which are mounted a plurality of resiliently deformable segments or slabs 110. Segments or slabs 110 are spaced slightly apart to allow the first and second gripper parts 102, 104 to collapse as much as possible during the lasting phase of the shoe making to minimize profiling. However, after the shoe is lasted, the columns or slabs rebound to their original size and shape so that, together with the bridging material 106, 108 form contoured gripping portions or parts. The spacing of the resiliently deformable segments or slabs 110 on the first gripper part 102 is such as to leave an unsupported segment or gap 112 for accommodating the sural nerve of the wearer, i.e. similar to notch 26 in FIG. 3.

The bottom edge of the first gripper part or lateral component 102, being that portion of the heel stabilizer that contacts the heel, should be between 10 mm and 30 mm above the top edge of the sock liner, ideally at about 20 mm, for a US Woman Size 6. The medial edge of the lateral component should be between 8 mm and 28 mm from the center line of the heel counter, ideally at about 18 mm, for a US Woman Size 6.

The bottom edge of the second gripper part medial component 104, being that portion of the heel stabilizer that contacts the heel, should be between 8 mm and 28 mm above the top edge of the sock liner, ideally at about 18 mm, for a US Woman Size 6. The medial edge of the medial component should be between 8 mm and 28 mm from the center line of the heel counter, ideally at about 18 mm, for a US Woman Size 6.

The heel stabilizer may be used with all of types of footwear, including but not limited to slip-on shoes, lace-up shoes, boots, high heels, low heels, flats, loafers, oxfords and any other type of shoe or boot. The heel stabilizer may also be used with all types of athletic shoes including specialized footwear, including but not limited to ski boots, golf shoes, track shoes, bike shoes, bowling shoes, roller skates, ice skates, and the like. Further, any type of footwear in which stabilization of the wearer's heel within the footwear is desirable is encompassed by the scope of this disclosure.

The heel stabilizer of the present invention provides numerous benefits for both flats and low heel shoes and mid and high heel shoes, including:

For flats and low heels:

1. Reduced heel slippage while walking
2. Reduced potential for heel blister formation
3. Foot centered in shoe
4. Improved heel fit
5. Improved support to heel bone (calcaneus)
6. Less heat build-up in the heel of the shoe For mid and high heels:

1. Improved stability while walking
2. Less toe gripping/crunching of toes

Potentially decrease hammertoe formation

3. Potential to reduce bunion pressure
4. Potential to reduce forefoot pressure
5. Improved heel wear
6. Better balance It should be emphasized that the above-described embodiments of the present disclosure, particularly any "preferred" embodiments, are merely possible examples of implementations, merely set forth for a clear understanding of the principles of the disclosed system and method. Many variations and modifications may be made to the above-described embodiments of the disclosure without departing substantially from the spirit and principles of the disclosure. All such modifications and variations are intended to be included herein within the scope of this disclosure and protected by the following claims.

The invention claimed is:

1. A heel stabilizer for insertion into human footwear, said stabilizer comprising a first gripping portion or part and a second gripping portion or part, wherein said first and second gripping portions or parts upon insertion into said human footwear protrude away from an inner surface of the footwear, wherein said first gripping portion or part is adjacent to a medial surface of a wearer's heel and said second gripping portion or part is adjacent to a lateral surface of the wearer's heel when the footwear is worn, wherein the first gripping portion or part and the second gripping portion or part each comprise a plurality of spaced resiliently deformable columns or segments fixed to a bridging material, and wherein the spacing of the resiliently deformable columns or segments of the second gripping portion or part is such so as to leave an unsupported segment or gap for accommodating the sural nerve of the wearer, and wherein the first and second gripping portions or parts are configured to contact the medial and lateral surfaces of the wearer's heel above the widest portion of the wearer's heel.

2. The heel stabilizer of claim 1, wherein said first gripping portion or part is larger than said second gripping portion or part.

3. The heel stabilizer of claim 1, wherein the stabilizer is molded into an inner surface of the footwear.

4. A heel stabilizer for insertion into human footwear, said stabilizer comprising a backing, a first gripping portion or part protruding away from the backing and a second gripping portion protruding or part away from the backing, wherein said first gripping portion or part upon insertion into said human footwear is adjacent to a medial surface of a wearer's heel and said second gripping portion or part is adjacent to a lateral surface of a wearer's heel when the stabilizer is inserted and the footwear is worn, wherein the first gripping portion or part and the second gripping portion or part each comprise a plurality of spaced resiliently deformable columns or segments fixed to a bridging material, wherein the spacing of the resiliently deformable columns or segments of the second gripping portion or part is such so as to leave an unsupported segment or gap for accommodating the sural nerve of the wearer, and wherein the first and second snipping portions or parts are configured to contact the medial and lateral surfaces of the wearer's heel above the widest portion of the wearer's heel when the stabilizer is inserted and the footwear is worn.

5. The heel stabilizer of claim 4, further comprising an adhesive portion on the backing.

6. The heel stabilizer of claim 4, wherein the first and second gripping portions or parts are located below a top edge of the footwear when the stabilizer is inserted.

7. The heel stabilizer of claim 4, wherein said first gripping portion or part is larger than said second gripping portion or part.

8. The heel stabilizer of claim 4, further comprising at least one footwear alignment indicator.

9. Human footwear comprising a heel stabilizer, said stabilizer comprising a first gripping portion or part and a second gripping portion or part, wherein said first and second gripping portions or parts protrude away from an inner surface of the footwear, and wherein said first gripping portion or part is adjacent to a medial surface of a wearer's heel and said second gripping portion or part is adjacent to a lateral surface of the wearer's heel when the footwear is worn, wherein the first gripping portion or part and the second gripping portion or part each comprise a plurality of spaced resiliently deformable columns or segments fixed to a bridging material, wherein the spacing of the resiliently deformable columns or segments of the second gripping portion is such so as to leave an unsupported segment or gap for accommodating the sural nerve of the wearer, and wherein the first and second gripping portions or parts are configured to contact the medial and lateral surfaces of the wearer's heel above the widest portion of the wearer's heel.

10. The footwear of claim 9, wherein said first gripping portion or part is larger than said second gripping portion or part.

11. The footwear of claim 9, wherein the first gripping portion or part and the second gripping portion or part each comprise a plurality of spaced resiliently deformable columns or segments fixed to the bridging material.

12. The footwear of claim 9, wherein said footwear is a shoe.

13. The footwear of claim 9, wherein said footwear is a boot.

14. The footwear of claim 9, wherein said footwear comprises athletic footwear selected from the group consisting of a ski boot, a golf shoe, a track shoe, a bike shoe, a bowling shoe, an ice skate, and a roller skate.

* * * * *